US010969732B2

(12) United States Patent
Suzuki

(10) Patent No.: US 10,969,732 B2
(45) Date of Patent: Apr. 6, 2021

(54) IMAGE FORMING APPARATUS INCLUDING OPTICAL PRINT HEAD

(71) Applicant: CANON KABUSHIKI KAISHA, Tokyo (JP)

(72) Inventor: Takako Suzuki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/667,378

(22) Filed: Oct. 29, 2019

(65) Prior Publication Data

US 2020/0133193 A1 Apr. 30, 2020

(30) Foreign Application Priority Data

Oct. 29, 2018 (JP) ..... JP2018-202689

(51) Int. Cl.
*G03G 15/00* (2006.01)
*G03G 21/16* (2006.01)
*G03G 21/18* (2006.01)

(52) U.S. Cl.
CPC ..... *G03G 21/1666* (2013.01); *G03G 21/1647* (2013.01); *G03G 21/1867* (2013.01); *G03G 21/1652* (2013.01)

(58) Field of Classification Search
CPC ..... G03G 21/1619; G03G 21/1647; G03G 21/1652; G03G 21/1867; G03G 21/1666
See application file for complete search history.

(56) References Cited

U.S. PATENT DOCUMENTS 7,773,905 B2 8/2010 Kuruma
8,040,368 B2 * 10/2011 Yokoi ..... G03G 15/04054 347/224
8,705,999 B2 * 4/2014 Okabe ..... G03G 15/80 399/90
9,069,324 B2 6/2015 Mori

FOREIGN PATENT DOCUMENTS

JP 08-319040 A 12/1996
JP 2008-276117 A 11/2008
JP 2009-157001 A 7/2009
JP 2014-044333 A 3/2014

* cited by examiner

*Primary Examiner* — Hoang X Ngo
(74) *Attorney, Agent, or Firm* — Venable LLP

(57) ABSTRACT

An image forming apparatus includes a main assembly and a drawer unit. The drawer unit includes a rotatable photosensitive member, an optical print head including a light emitting element, a substrate, an electroconductive member, and a first grounding member. The accommodating portion includes a second grounding member configured to ground the electroconductive member in contact with the first grounding member when the drawer unit is positioned between an accommodated position and a drawn-out position.

16 Claims, 8 Drawing Sheets

(b)

(a)

(a)

(b)

(c)

(a)

(b)

(a)

(b)

IMAGE FORMING APPARATUS INCLUDING OPTICAL PRINT HEAD

FIELD OF THE INVENTION AND RELATED ART

The present invention relates to an image forming apparatus for forming an image with an optical print head.

In a printer which is an image forming apparatus of an electrophotographic type, the following light exposure type has been known in general. That is, a light exposure type in which a photosensitive drum is exposed to light by using a light exposure head such as a light emitting diode (LED) or an organic electroluminescence (EL) element and a latent image is formed has been known in general. The exposure head includes a light emitting element array arranged in a longitudinal direction of the photosensitive drum and a rod lens array for forming an image on the photosensitive drum with light from the light emitting element array. As regards the LED or the organic EL element, a constitution having a surface (planar) emitting shape such that an irradiation direction of light from a light emitting surface is the same direction as the rod lens array has been known. Here, a length of the light emitting element array is determined depending on a width of an image forming region on the photosensitive drum, and an interval between light emitting elements is determined depending on resolution of the printer. For example, in the case of the printer of 1200 dpi in resolution, a pixel interval is 21.16 μm, and therefore, the interval between the light emitting elements is also an interval corresponding to 21.16 μm. In the printer using such an exposure head, compared with a printer of a laser scanning type in which the photosensitive drum is scanned with a laser beam deflected by a rotatable polygonal mirror, the number of component parts is small, and therefore, downsizing and cost reduction of the printer are easy. Further, in the printer using the exposure head, noise generating by rotation of the rotatable polygonal mirror is reduced.

Further, a plurality of light emitting elements are formed on a single semiconductor chip, so that a surface emitting element array chip is prepared. A plurality of surface emitting element array chips are arranged on a substrate in a staggered configuration, and for example, a constitution in which an image corresponding to an image width of about 314 mm can be formed has been carried out in general.

Further, an image forming apparatus including a top cover provided to be rotatable at an upper portion of a main assembly frame and a light exposure head which is supported so as to be hung from the top cover and which is swingable relative to the top cover has been known. In such a constitution, in some cases, a cable for sending a current to the exposure head when the top cover is opened is exposed to a user side. In a state in which the top cover is open, when a user's fingers approach the cable, static electricity moves from the fingers to the cable and has the influence on a control substrate connected to the cable in some cases. For that reason, a constitution, in which even when the cable is exposed to the user side in the state in which the top cover is open, movement of the static electricity from the user's fingers to the cable is suppressed by providing an electroconductive portion on a side closer to the user than to the cable, has been proposed (Japanese Laid-Open Patent Application 2014-044333). As an image forming apparatus in which such a constitution is changed and in which a plurality of photosensitive drums and a plurality of light exposure heads for exposing the photosensitive drums to light are provided, an image forming apparatus having the following structure has been developed. That is, the image forming apparatus includes a supporting member for integrally supporting process cartridges including the photosensitive drums and supporting the exposure heads, and the supporting member is capable of being drawn out of an apparatus main assembly of the image forming apparatus.

However, in the structure in which the process cartridges and the exposure heads are capable of being integrally drawn out of the apparatus main assembly, the following problem arises. In the constitution in which the exposure head is supported so as to be hung from the top cover, the exposure head is not drawn out of the apparatus main assembly, and grounding of the exposure head can be established via the apparatus main assembly by connecting the exposure head and the top cover by using a grounding wire such as a metal plate member or a flexible electroconductive wire or the like. However, in the structure of a drawing-out type, even if a grounding member is provided on the apparatus main assembly side, when the exposure head is drawn-out of the apparatus main assembly, the exposure head and the grounding member are disconnected with each other and thus are in a state in which the grounding is not established. For that reason, there is a liability that when the user's fingers contact the exposure head during the drawing-out of the exposure head, the static electricity moves from the user's fingers and has the influence on electric elements of the exposure head.

Therefore, it is desired that in a constitution in which a casing including the photosensitive drum and the exposure head is capable of being drawn out of an image forming apparatus main assembly, grounding between the exposure head and the apparatus main assembly can be established even when the casing is moved relative to the apparatus main assembly.

SUMMARY OF THE INVENTION

According to an aspect of the present invention, there is provided an image forming apparatus comprising: a main assembly; and a drawer unit movable between an accommodated position where the drawer unit is accommodated in an accommodating portion provided in the main assembly and a drawn-out position where the drawer unit is drawn out of the accommodated position, wherein the drawer unit comprises, a rotatable photosensitive member, an optical print head including a light emitting element configured to emit light to which the photosensitive member is exposed, a substrate including the light emitting element, and an electroconductive member of metal which is provided separately from the substrate and is extending in a rotational axis direction of the photosensitive drum, and a first grounding member connected to the electroconductive member, wherein the accommodating portion includes a second grounding member configured to ground the electroconductive member in contact with the first grounding member when the drawer unit is positioned between the accommodated position and the drawn-out position.

Further features of the present invention will become apparent from the following description of exemplary embodiments with reference to the attached drawings.

BRIEF DESCRIPTION OF THE DRAWINGS

Parts (a) to (c) of FIG. 1 are schematic sectional views each showing a structure of an image forming apparatus of embodiments 1 and 2.

Part (a) of FIG. 2 is a perspective view for illustrating a positional relationship between a light exposure head and a photosensitive drum in the embodiments 1 and 2, and part (b) of FIG. 2 is a schematic view for illustrating a structure of the exposure head in the embodiments 1 and 2.

Figure 3:
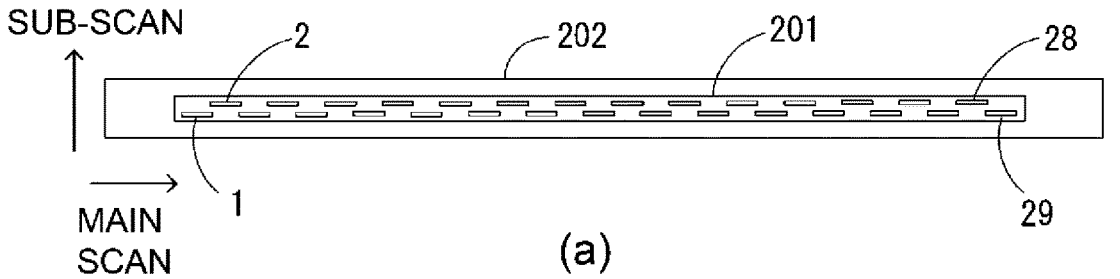
Figure 3:
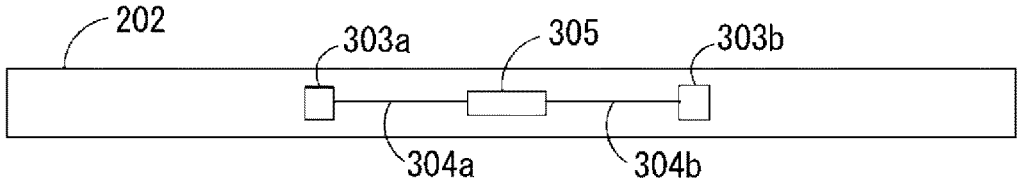
Figure 3:
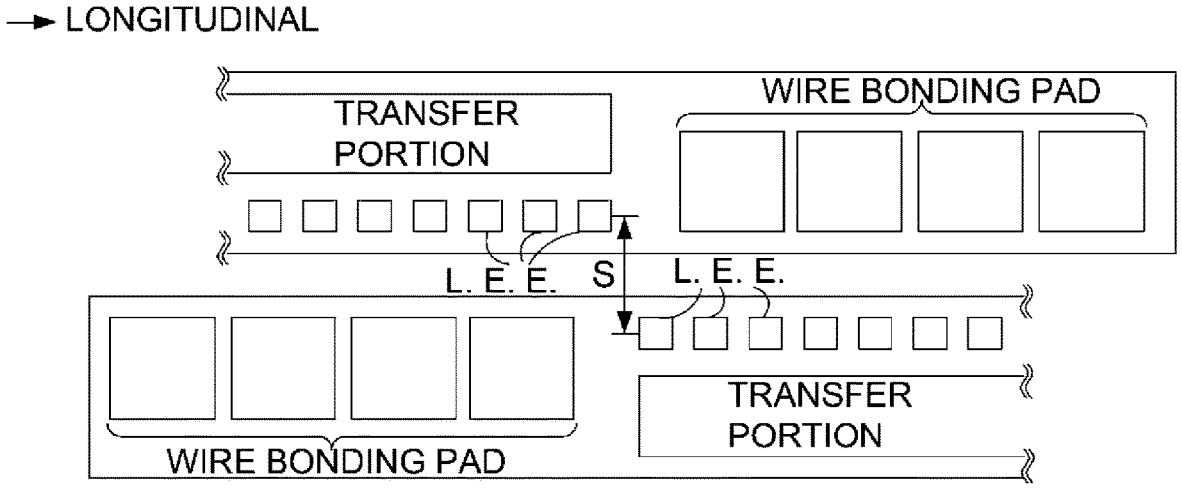

Parts (a) and (b) of FIG. 3 are schematic views each showing a driving substrate in the embodiments 1 and 2, and part (c) of FIG. 3 is a schematic view for illustrating a structure of surface emitting element array chips in the embodiments 1 and 2.

Figure 4:
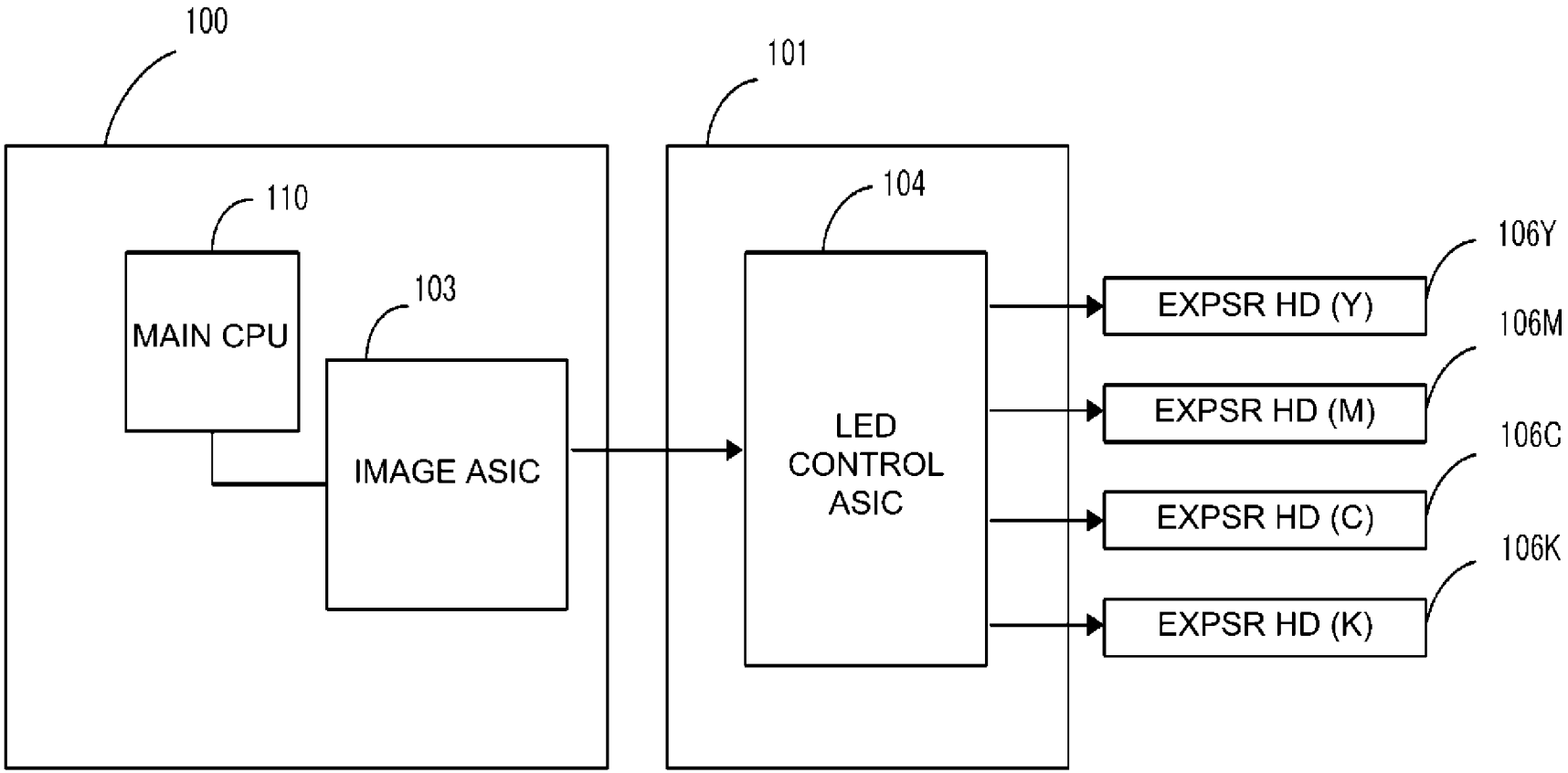

FIG. 4 is a control block diagram of a control substrate in the embodiments 1 and 2.

Figure 5:
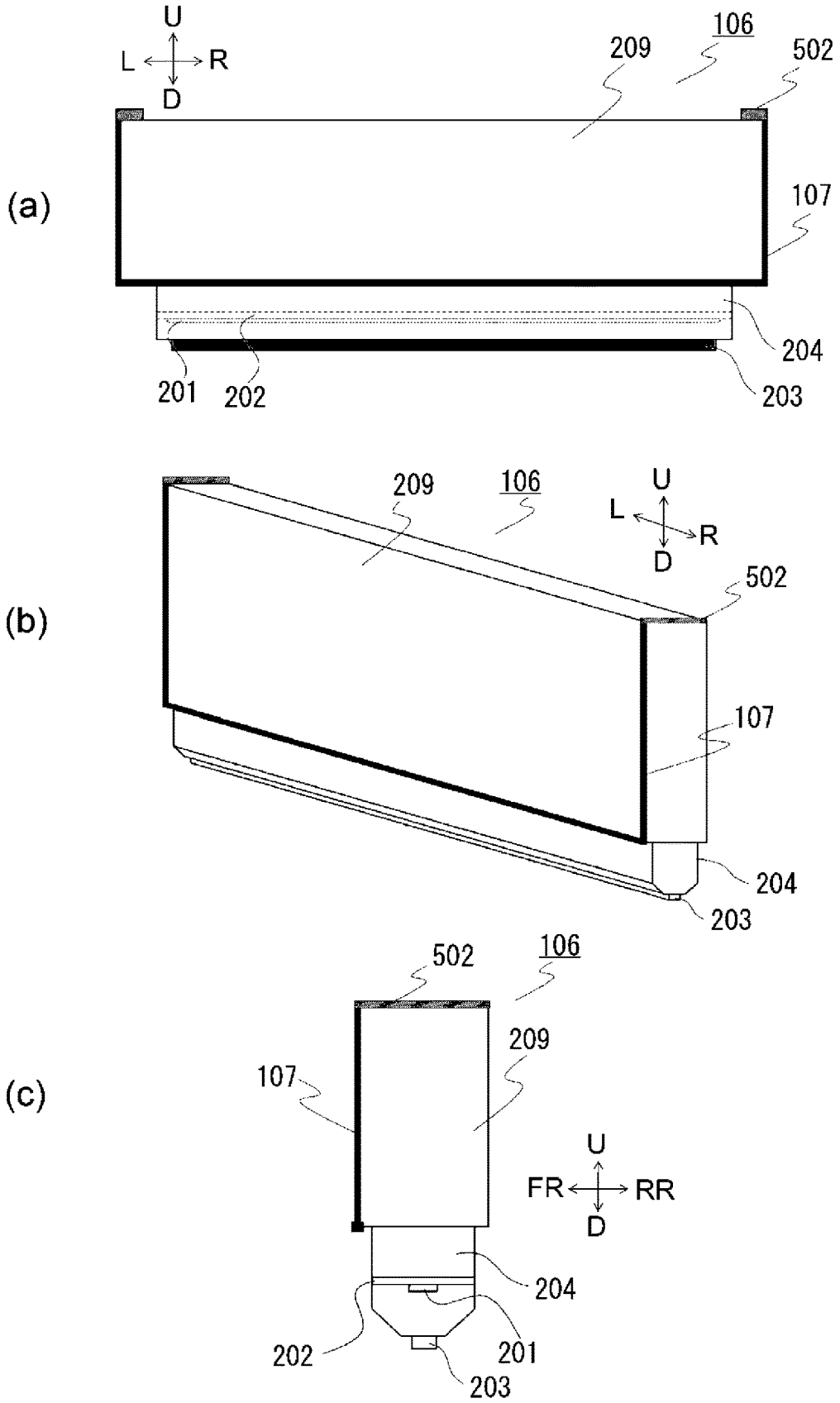

Parts (a) to (c) of FIG. 5 are schematic views of a light exposure head in the embodiments 1 and 2, in which part (a) is a front view, part (b) is a perspective view, and part (c) is a right side view.

Figure 6:
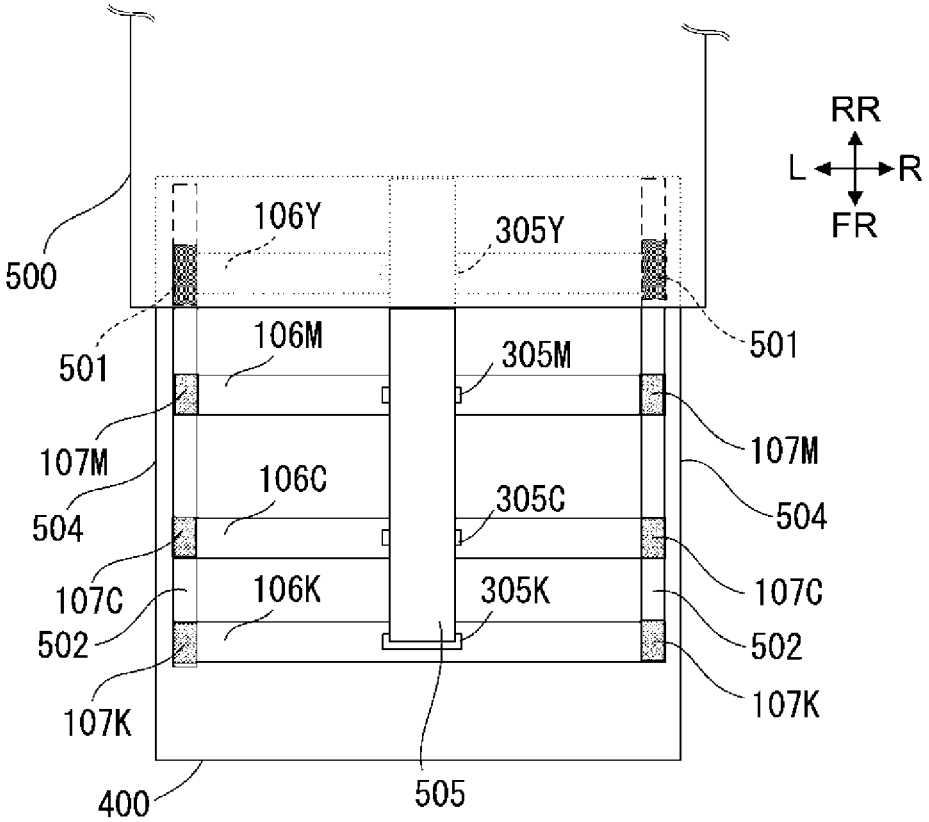
Figure 6:
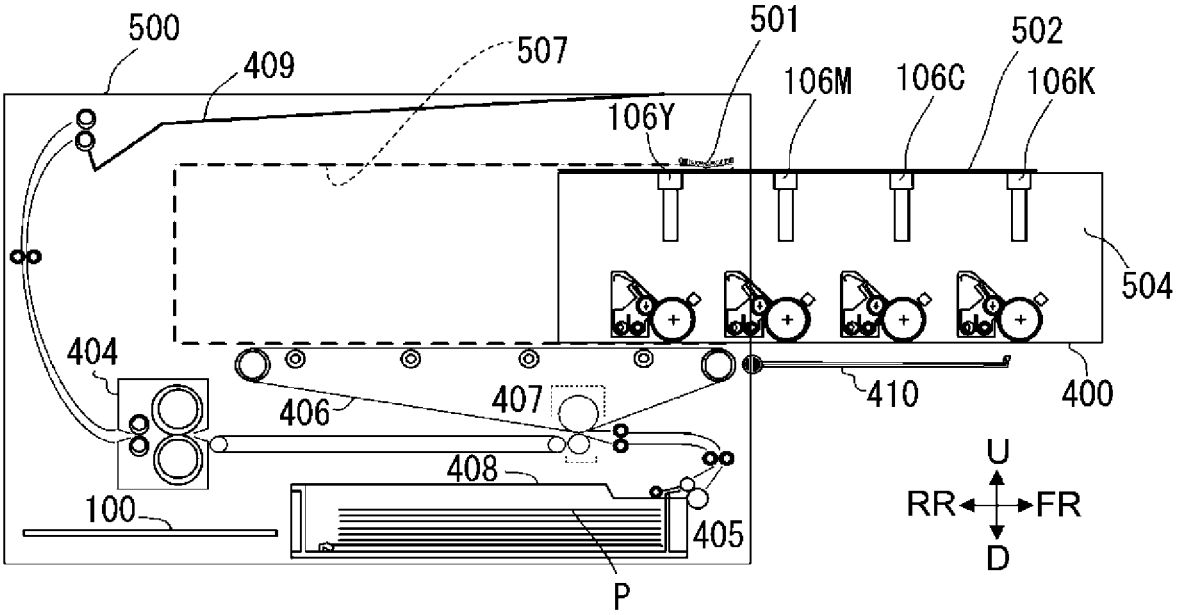

Parts (a) and (b) of FIG. 6 are schematic views showing structures of an image forming station and an image forming apparatus main assembly in the embodiment 1, in which part (a) is a top (plan) view, and part (b) is a side view.

Figure 7:
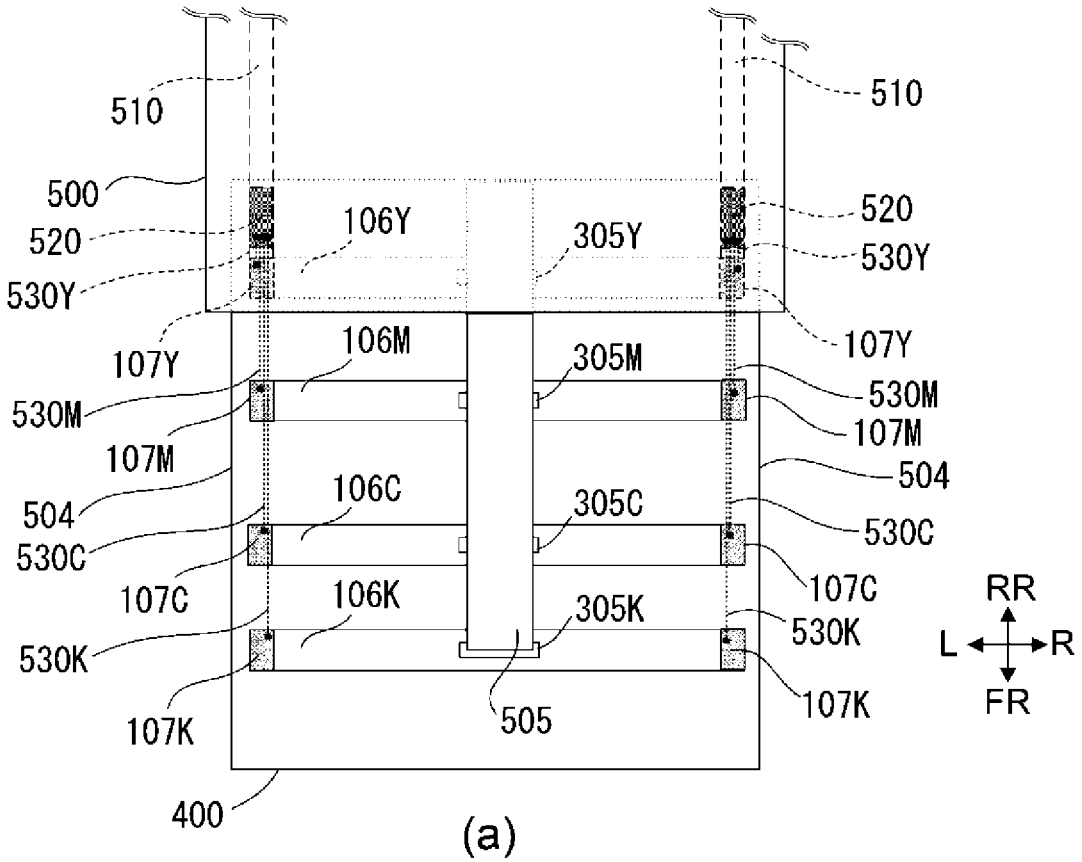
Figure 7:
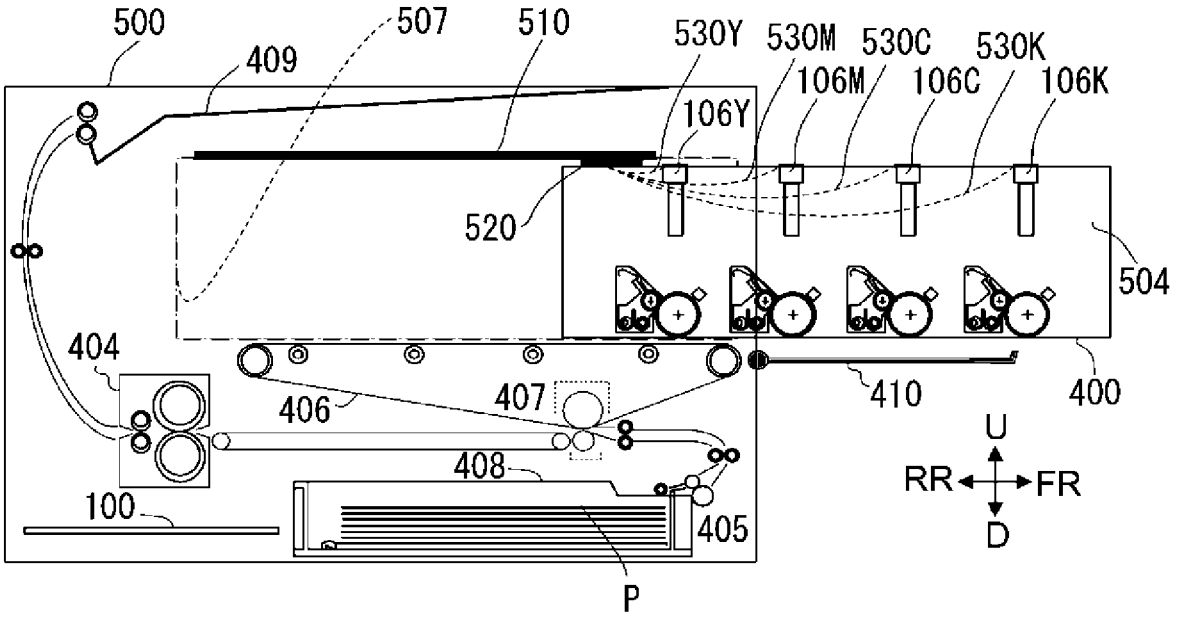

Parts (a) and (b) of FIG. 7 are schematic views showing structures of an image forming station and an image forming apparatus main assembly in another embodiment of the embodiment 1, in which part (a) is a top view, and part (b) is a side view.

Figure 8:
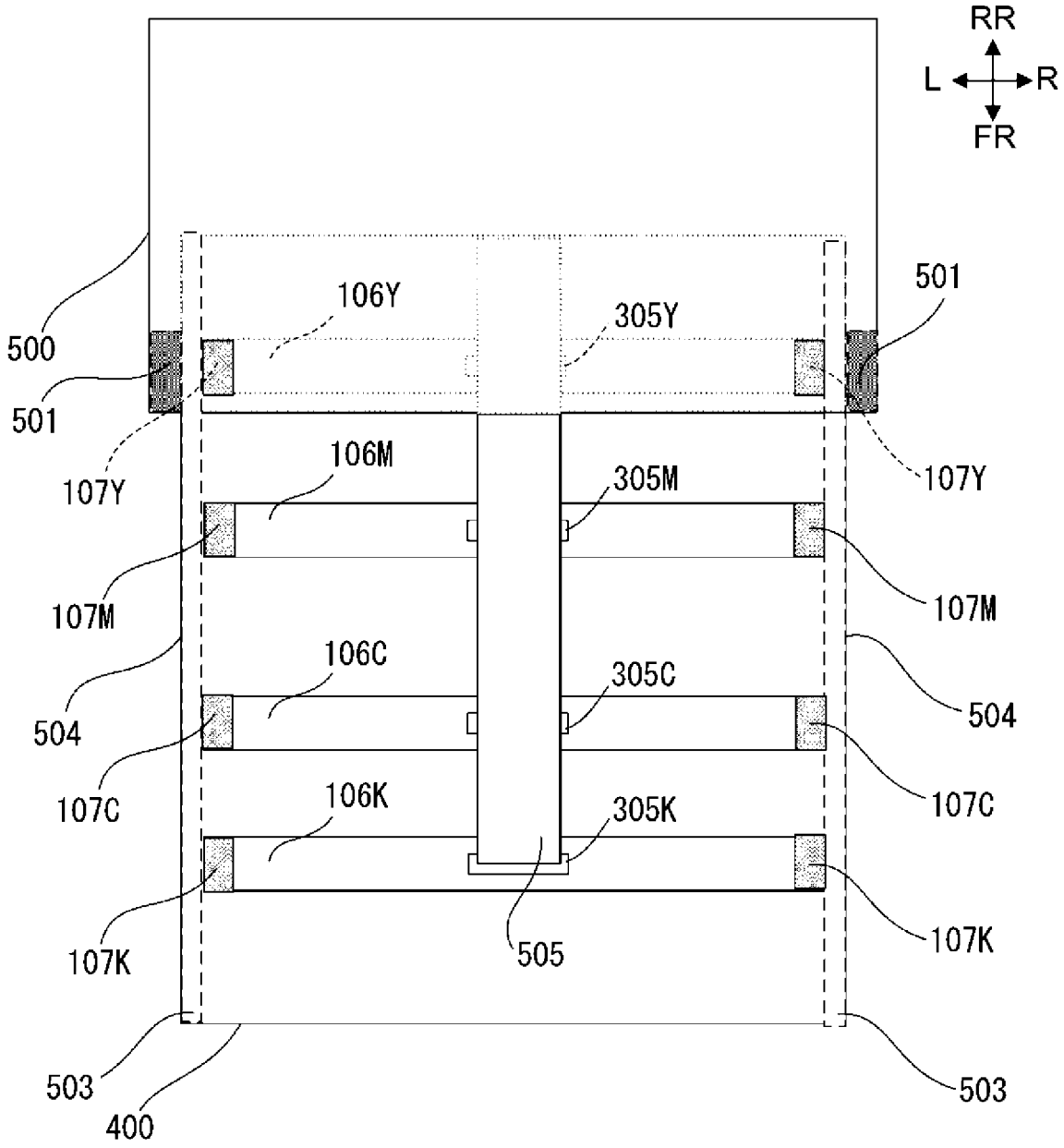

FIG. 8 is a top view showing a structure of an image forming station and an image forming apparatus main assembly in the embodiment 2.

DESCRIPTION OF EMBODIMENTS

In the following, embodiments of the present invention will be specifically described with reference to the drawings.

Embodiment 1

[Structure of Image Forming Apparatus]

Figure 1:
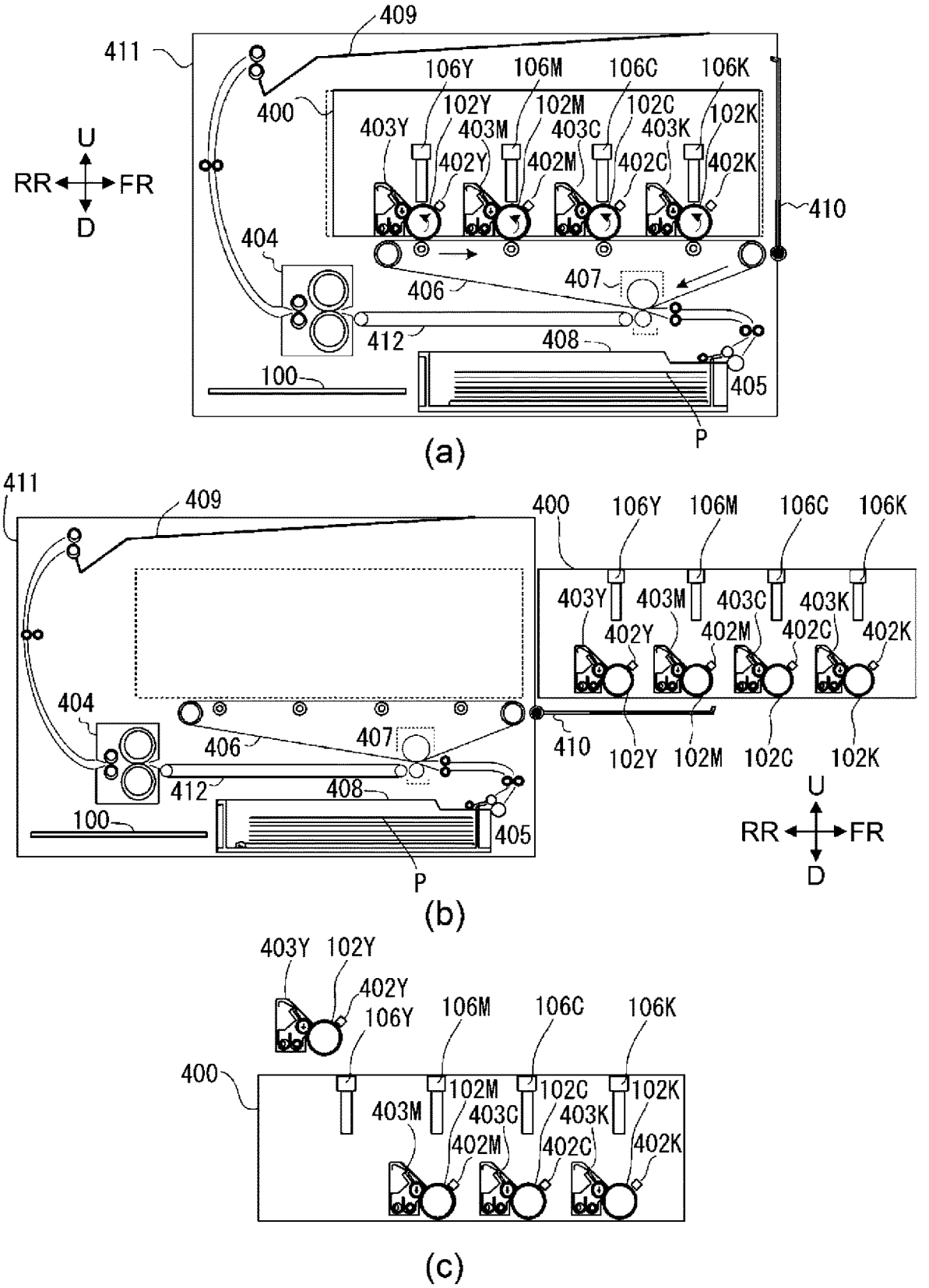

Part (a) of FIG. 1 is a schematic sectional view showing a structure of an image forming apparatus of an electrophotographic type in embodiment 1. The image forming apparatus shown in part (a) of FIG. 1 includes an outer casing 411 (an example of an apparatus main assembly), an image forming station (inner casing) 400 (an example of a drawer unit), a fixing portion 404, a sheet (paper) feeding/conveying portion 405, a door 410 for opening and closing a drawing-out opening of the inner casing 400, and a control substrate 100 including a controller (not shown) for controlling image formation. Incidentally, in parts (a) and (b) of FIG. 1, "FR" (right side of the drawing sheet) is a frontward direction of the image forming apparatus, and "RR" (left side of the drawing sheet) is a rearward direction of the image forming apparatus. Further, "U" (upper side of the drawing sheet) is a top (upward) direction of the image forming apparatus, and "D" (lower side of the drawing sheet) is a bottom (downward) direction of the image forming apparatus.

The inner casing 400 is a unit which includes therein four process cartridges (image forming portion) of different toner colors of yellow (Y), magenta (M), cyan (C) and black (K) and which is capable of being drawn out of and mounted in the image forming apparatus. The inner casing 400 includes an open surface which is open upward and downward and an outer peripheral side surface portion thereof is surrounded by side walls (side wall 504 described later). The inner casing 400 also supports light exposure heads 106 described later. That is, by drawing-out the inner casing 400 from the image forming apparatus, the inner casing 400 can be dismounted from the image forming apparatus. The respective process cartridges have the same constitution, and each process cartridge is constituted by a photosensitive drum 102 which is a rotatable photosensitive member, a charging device 402 and a developing device 403. Further, the exposure head 106 is provided opposed to the photosensitive drum 102 of each process cartridge.

Incidentally, suffixes Y, M, C and K of reference numerals represent members of the process cartridges for yellow, magenta, cyan and black, respectively. In the following, description of the suffixes will be omitted except for the case where description of a specific process cartridge is made.

When image formation is started, in each of the process cartridges, the charging device 402 electrically charges uniformly a surface of the photosensitive drum 102 rotationally driven in an arrow direction (counterclockwise direction) in the figure. Then, the exposure head 106 which is an optical print head causes a chip surface of an LED array to emit light depending on irradiation data, and the emitted light is condensed at the surface of the photosensitive drum 102 by a rod lens array, so that an electrostatic latent image is formed. The developing device 403 deposits the toner on the electrostatic latent image formed on the photosensitive drum 102, and thus develops the electrostatic latent image with the toner, so that a toner image is formed.

A transfer belt 406 is an endless belt which is provided between a sheet (paper) feeding cassette 408 and the respective photosensitive drums 102 and which is rotatable in an arrow direction (clockwise direction) in the figure while being stretched by a plurality of rollers. Further, at positions opposing the photosensitive drums 102, transfer rollers are provided inside the transfer belt 406 so as to sandwich the transfer belt 406 between the transfer rollers and the photosensitive drums 102. The toner images formed on the photosensitive drums 102 of the process cartridges are transferred onto the transfer belt 406 contacted to the photosensitive drums 102 by the transfer rollers, whereby the respective color toner images are superposed on the transfer belt 406, so that a full-color toner image is formed.

On the other hand, in synchronism with the image formation of the respective process cartridges of the inner casing 400, a recording medium (material) P is fed from the sheet feeding cassette 408 of the sheet feeding/conveying portion 405 and is conveyed toward a secondary transfer device 407. In the secondary transfer device 407, the toner images on the transfer belt 406 are transferred onto the fed recording material P. Then, the recording material P on which the toner images are transferred is conveyed to a fixing portion 404 by a conveying belt 412. In the fixing portion 404, unfixed toner images on the conveyed recording material P are pressed and heated, so that the toner images are fixed on the recording material P. Thereafter, the recording material P is conveyed in a conveying passage and is discharged onto a discharge tray 409.

Part (b) of FIG. 1 is a sectional view showing a state in which the inner casing (image forming station) 400 which is the example of the drawer unit is drawn out of the image forming apparatus. Thus, the image forming apparatus in this embodiment includes an apparatus main assembly (an outer casing 411) and the image forming station (inner casing) 400 which is capable of being mounted in and drawn out of the apparatus main assembly. That is, the outer casing 411 referred to herein refers to a portion, of the image forming apparatus, other than the image forming station (inner casing) 400. Part (b) of FIG. 1 shows a state in which the inner casing (image forming station) 400 is drawn out of the casing 411 through an opening to an outside of the image forming apparatus. The opening appears by movement of the door 410, provided rotatably as shown in part (a) of FIG. 1, from a closed state to an open state. The door 410 is an openable door for permitting access to an inside of the inner casing 400 in order to draw out the inner casing 400 from the apparatus main assembly 500. When the door 410 is in the closed state, the opening is covered with the door 410. On the other hand, when the door 410 is in the open state, the opening is open, so that through this opening, an operation for mounting the image forming station (inner casing) 400 in the apparatus main assembly and for drawing-out the image forming station (inner casing) 400 from the apparatus main assembly can be performed. In the image forming apparatus of this embodiment, rail members (not shown) on which the inner casing 400 is mounted are provided along an inserting direction of the inner casing 400 in order to facilitate an inserting and drawing-out operation of the inner casing 400. The inner casing 400 is mounted on the rail members and is guided by the rail members, so that the inner casing 400 is movable inside the image forming apparatus. Further, when the opening operation of the door 410 is performed, by an unshown mechanism, the photosensitive drums 102 of the respective process cartridges are spaced from the transfer belt 406. Similarly, the exposure heads 106 are also moved in an upward direction (top surface direction) by an unshown mechanism, and are spaced from the photosensitive drums 102 of the process cartridges. On the other hand, when the closing operation of the door 410 is performed, the exposure heads 106 are moved in a downward direction (bottom direction) by the unshown mechanism to positions where the surfaces of the photosensitive drums 102 of the respective process cartridges are exposed to light by the exposure heads 106.

Part (c) of FIG. 1 is a sectional view showing a state in which the process cartridge for yellow (Y) is dismounted from the inner casing 400. The process cartridge in this embodiment is prepared by integrally assembling the photosensitive drum 102, the charging device 402 and the developing device 403 into a unit, and has a constitution in which the process cartridge is easily dismounted from the inner casing 400 and can be exchanged with new one.

[Structure of Light Exposure Head]

Figure 2:
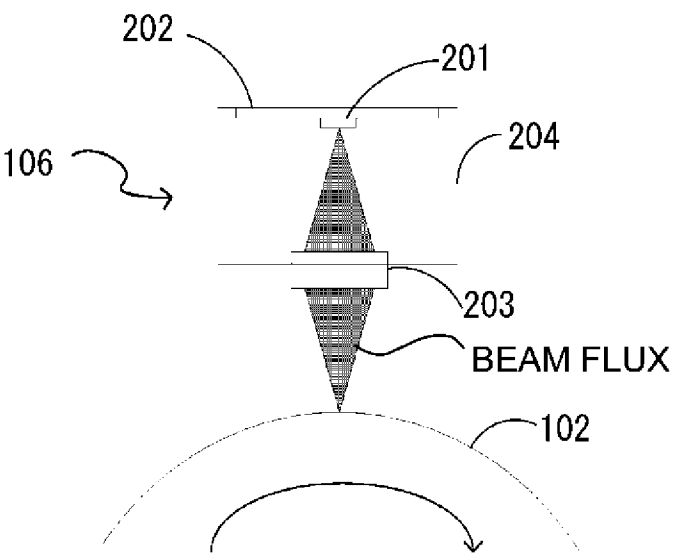
Figure 2:
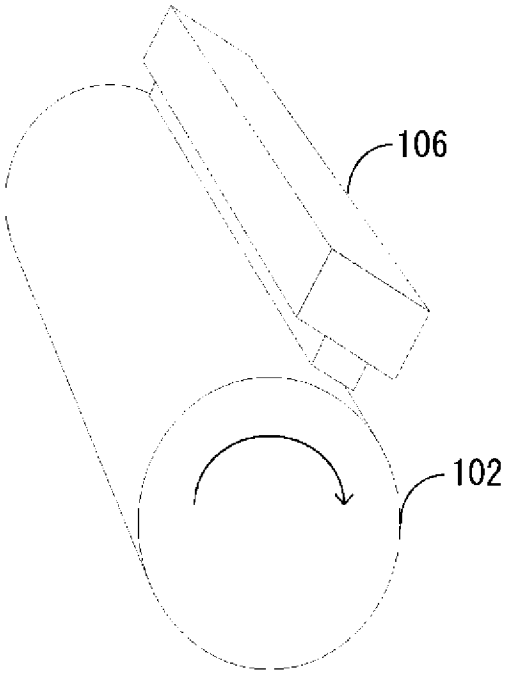

Next, the exposure head 106 for performing the exposure of the photosensitive drum 102 to light will be described using FIG. 2. Part (a) of FIG. 2 is a perspective view showing a positional relationship between the exposure head 106 and the photosensitive drum 102, and part (b) of FIG. 2 is a schematic view for illustrating an internal structure of the exposure head 106 and a state in which a beam flux from the exposure head 106 is concentrated at the photosensitive drum 102 by a rod lens array 203. As shown in part (a) of FIG. 2, the exposure head 106 is mounted in the inner casing 400 by a mounting member (not shown) at a position which is above the photosensitive drum 102 rotating in an arrow direction and where the exposure head 106 opposes the photosensitive drum 102.

As shown in part (b) of FIG. 2, the exposure head 106 is constituted by a driving substrate 202 which is an exposure-side substrate, a surface emitting element array element group 201 mounted on the driving substrate 202, the rod lens array 203 and a housing 204. To the housing 204, the rod lens array 203 and the driving substrate 202 are mounted. The rod lens array 203 concentrates a beam flux (light flux), from the surface emitting element array element group 201, onto the photosensitive drum 102. In a factory, an assembling adjustment operation of the exposure head 106 alone is performed, so that focus adjustment and light intensity adjustment of each of spots are carried out. Here, the assembling adjustment is carried out so that a distance between the photosensitive drum 102 and the rod lens array 203 and a distance between the rod lens array 203 and the surface emitting element array element group 201 are predetermined intervals (distances). As a result, the light from the surface emitting element array element group 201 is formed on the photosensitive drum 102. For that reason, during focus adjustment in the factory, a mounting position of the rod lens array 203 is performed so that the distance between the rod lens array 203 and the surface emitting element array element group 201 is a predetermined value. Further, during light intensity adjustment in the factory light emitting elements of the surface emitting element array element group 201 are successively caused to emit light, and adjustment of a driving current of each of the light emitting elements is carried out so that the light concentrated at the surface of the photosensitive drum 102 via the rod lens array 203 has a predetermined light intensity.

[Structure of Surface Emitting Element Array Element Group]

FIG. 3 is a schematic view for illustrating the surface emitting element array element group 201. Part (a) of FIG. 3 is a schematic view showing a structure of a surface (first surface) of the driving substrate 202 on which the surface emitting element array element group 201 is mounted, and part (b) of FIG. 3 is a schematic view showing a structure of a surface (second surface) of the driving substrate 202 opposite from the first surface on which the surface emitting element array element group 201 is mounted.

As shown in part (a) of FIG. 3, the surface emitting element array element group 201 has a constitution in which 29 surface emitting element array chips 1 to 29 are arranged in two rows in a staggered shape along a longitudinal direction of the driving substrate 202. Incidentally, in part (a) of FIG. 3, an up-down direction shows a sub-scan direction (rotational direction of the photosensitive drum 102) which is a first direction, and a horizontal direction shows a main scan direction which is a second direction perpendicular to the sub-scan direction. The main scan direction is also a direction crossing the rotational direction of the photosensitive drum 102. Each of elements of the surface emitting element array element group 201 having 516 light emitting points in total is arranged with a predetermined resolution pitch in a longitudinal direction of the surface emitting element array chips. In this embodiment, the pitch of each element of the surface emitting element array chips is about 21.16 μm (≈2.54 cm/1200 dots) which is a pitch of a resolution of 1200 dpi which is a first resolution. As a result, an end-to-end interval of the 516 light emitting points in one (single) surface emitting element array chip is about 10.9 mm (≈21.16 μm×516). The surface emitting element array element group 201 is constituted by 29 surface emitting element array chips. The number of light emitting elements, of the surface emitting element array element group 201, capable of exposing the photosensitive drum to light is 14,964 elements (=516 elements×29 chips), so that image formation corresponding to an image width of about 316 mm (≈10.9 mm×29 chips) with respect to the main scan direction is possible.

Part (c) of FIG. 3 is a schematic view showing a state of a boundary between chips of the surface emitting element array chips disposed in the two rows along the longitudinal direction, and the horizontal direction is the longitudinal direction of the surface emitting element array element group 201 of part (a) of FIG. 3. As shown in part (c) of FIG. 3, at an end portion of the surface emitting element array chips, wire bonding pads to which a control signal is inputted are provided, and by a signal inputted from the wire bonding pads, a transfer portion and the light emitting elements are driven. Further, the surface emitting element array chips include a plurality of light emitting elements. The plurality of light emitting elements are arranged along the rotational axis direction of the photosensitive drum 102. Even at a boundary between the surface emitting element array chips, a pitch (an interval between center points of two light emitting elements) of the light emitting elements with respect to the longitudinal direction is about 21.16 μm which is a pitch of the resolution of 1200 dpi. Further, the surface emitting element array chips arranged in upper and lower (two) rows are disposed so that an interval between light emitting points of the upper and lower surface emitting element array chips (indicated by double-pointed arrow S) is about 84 μm (a distance which is an integral multiple of each resolution corresponding to 4 pixels in 1200 dpi, i.e., 8 pixels in 2400 dpi).

Further, as shown in part (b) of FIG. 3, on the surface of the driving substrate 202 opposite from the surface on which the surface emitting element array element group 201 is mounted, driving portions 303*a* and 303*b* and a connector 305 are mounted. The driving portions 303*a* and 303*b* disposed on both sides of the connector 305 drive the surface emitting element array chips 1 to 15 and the surface emitting element array chips 16 to 29, respectively. The driving portions 303*a* and 303*b* are connected to the connector 305 via patterns 304*a* and 304*b*, respectively. To the connector 305, signal lines for controlling the driving portions 303*a* and 303*b*, a power source voltage, and the ground are connected, and the power source voltage and the ground are connected to the driving portions 303*a* and 303*b*. Further, from each of the driving portions 303*a* and 303*b*, wiring for driving the surface emitting element array element group 201 passes through an inner layer of the driving substrate 202 and is connected to the surface emitting element array chips 1 to 15 and the surface emitting element array chips 16 to 29. Incidentally, in this embodiment, each of the light emitting elements is a semiconductor light emitting diode (LED), but, for example, may also be an organic light emitting diode (OLED). This OLED is also called and organic electro-luminescence (OEL) device (element) and is a light emitting element of a current-drive type. The OLED is, for example, disposed on a thin film transistor (TFT) in a line along the main scan direction and is electrically connected in parallel by power source wiring provided similarly along the main scan direction.

[Control Constitution of Control Substrate and Light Exposure Head]

FIG. 4 is a block diagram for illustrating a control constitution of the control substrate 100 and the respective exposure heads 106 (106Y, 106M, 106C, 106K). The control substrate 100 is, as shown in FIG. 1, disposed at a lower portion of the casing 411 of the image forming apparatus, and includes a main CPU 110 for controlling the image formation and an image ASIC (application-specific integrated circuit: an example of a control circuit) 103. When the image ASIC 103 receives an image formation instruction from the main CPU 110, the image ASIC 103 outputs image data. In the image data, pixel data corresponding to each of the surface light emitting elements of the surface emitting element array chips 1 to 29 mounted on each of the exposure heads 106 are included. Then, the image ASIC 103 outputs the image data in a predetermined order. Incidentally, on the control substrate 100, various control circuits for controlling the image formation are provided, but in this embodiment, only the control circuit relating to the control of the exposure heads 106 is described, and other control circuits will be omitted from description.

An LED control substrate 101 includes an LED control ASIC 104. The LED control ASIC 104 is connected to the exposure heads 106Y, 106M, 106C and 106K corresponding to the respective process cartridges via a flat cable 505 for transmitting signals, described later. The LED control ASIC 104 receives the image data outputted from the image ASIC 103 of the control substrate 100, and on the basis of the received image data, generates irradiation data corresponding to the respective surface light emitting elements of the surface emitting element array chips 1 to 29 mounted on the exposure heads 106. The image data from the image ASIC 103 includes color information on whether or not the image data is for which color of yellow (Y), magenta (M), cyan (C) and black (K). On the basis of the color information, the LED control ASIC 104 outputs the irradiation data corresponding to the respective colors to the driving substrates 202 of the exposure heads 106 on which the surface emitting element array chips for the respective colors are mounted. The driving portions 303*a* and 303*b* mounted on each of the driving substrate 202 of the exposure heads 106 carries out turning-on control of the surface light emitting elements on the basis of the irradiation data received from the LED control ASIC 104.

[Structure of Grounding Member for Light Exposure Head]

Part (a) of FIG. 5 is a front view of the exposure head 106, in which a left-right direction is a longitudinal direction of the surface emitting element array electroconductive group 201. Part (b) of FIG. 5 is a perspective view of the exposure head 106. Part (c) of FIG. 5 is a right side view of the exposure head 106 as seen from the right(-hand) side. The side walls 504 support a resin frame 209, and the resin frame 209 supports the housing 204. The housing 204 supports the driving substrate 202 as shown in part (c) of FIG. 5. Thus, the driving substrate 202 is provided inside the housing 204. Further, the housing 204 supports the rod lens array 203. As described above, the driving substrate 202 is provided with the surface emitting element array electroconductive group 201. At a lower end of the resin frame 209, in other words, in the neighborhood of the housing 204, an electroconductive portion 107 which is an electroconductive member constituted by a metal wire, for example, is provided. The electroconductive portion 107 is a member made of metal which is provided separately from the driving substrate 202 and which extends in the rotational axis direction of the photosensitive drum 102. The electroconductive portion 107 passes from the lower end of the resin frame through left and right end sides of the resin frame 209 with respect to the left-right direction of the resin frame 209, and is connected to common grounding members 502 (an example of a first grounding member) provided at an upper portion of the resin frame 209. The common grounding members 502 are electrically connected to apparatus main assembly grounding members 501 which are an example of a second grounding member.

As regards the exposure head 106 in this embodiment, by employing such a constitution, even when the user brings his (her) fingers near to the housing 204 in order to perform cleaning of the rod lens array 203, for example, static electricity from the fingers moves to the electroconductive portion 107. For this reason, the static electricity does not move from the fingers to the driving substrate 202.

[Structure of Common Grounding Member]

With reference to FIG. 6, a structure in which the exposure head 106 and the grounding members of the apparatus main assembly 500 are grounded will be described. Part (a) of FIG. 6 is a top (plan) view of the apparatus main assembly 500 as seen from above, in which "FR" represents a front (surface) side (frontward direction) of the apparatus main assembly 500, and "RR" represents a rear (surface) side (rearward direction) of the apparatus main assembly 500. Part (b) of FIG. 6 is a side view of the apparatus main assembly 500 as seen from the side surface of the apparatus main assembly 500. Parts (a) and (b) of FIG. 6 are the schematic views of the apparatus main assembly 500, in which the inner casing 400 is drawn out of the apparatus main assembly 500 to a permitting position. The side walls 504 in part (b) of FIG. 6 are the side walls of the inner casing 400 and oppose the photosensitive drums 102 with respect to axial directions of the photosensitive drums 102. Incidentally, the inner casing 400 in which the plurality of photosensitive drums 102 and the plurality of exposure heads 106 are provided and arranged in constituted by the two side walls 504 (left and right side walls) which oppose the photosensitive drums 102 with respect to the axial directions and by front and rear (two) side walls (front and rear side walls).

When the inner casing 400 is drawn out of the apparatus main assembly 500 and is accommodated in the apparatus main assembly 500, the inner casing 400 moves in a front-rear direction (hereinafter referred to as a movement direction). Further, signals from the LED control ASIC 104 of the LED control substrate 101 are sent to the respective exposure heads 106 via the connectors 305. Each of the exposure heads 106 is connected to the LED control substrate 101 via the connector 305 and the flat cable 505.

The apparatus main assembly grounding members 501 are provided on the apparatus main assembly 500 side. The apparatus main assembly 500 includes an accommodating portion for accommodating the inner casing 400, and the accommodating portion is formed by a frame 507 and the door 410. Specifically, the accommodating portion for accommodating the inner casing 400 includes an upper surface, a lower surface, a left side surface, a right side surface and a rear surface which are defined by the frame 507 of the apparatus main assembly 500, and a front surface thereof is defined by the door 410. When the door 410 is in a closed state, the inner casing 400 is accommodated in the accommodating portion. The inner casing 400 also holds the exposure heads 106 and is movable between an accommodated position where the inner casing 400 is accommodated in the accommodating portion and a drawn-out position where the inner casing 400 is drawn out of the accommodating portion for the purpose of exchanging the inner casing 400. Here, the drawn-out position is a position where the inner casing 400 at least supported by the outer casing 411 is drawn out of the image forming apparatus; in other words, the inner casing 400 is drawn out to the extent that the user can perform an exchanging operation of the process cartridge(s). The apparatus main assembly grounding members 501 are, for example, as shown in part (b) of FIG. 6, provided on an upper side of the frame 507 and on an opening side, and are constituted by a leaf spring or the like, for example. The apparatus main assembly grounding members 501 are grounded through a member, made of metal, of the outer casing 411 constituting the image forming apparatus.

As shown in part (a) of FIG. 6, the common grounding members 502 common to all the exposure heads 106 connect the electroconductive portions 107 of the respective exposure heads 106. The common grounding members 502 are provided at positions where the common grounding members 502 always contact the apparatus main assembly grounding members 501, with respect to the longitudinal direction of the exposure head 106, provided on an upper surface of the inner casing 400 even when the inner casing 400 stops at a predetermined position and moves. In other words, the common grounding members 502 are provided to the inner casing 400 along the drawing-out direction (movement direction) of the inner casing 400. For this reason, a constitution, in which even when the inner casing 400 is drawn out of the apparatus main assembly 500, the apparatus main assembly grounding members 501 and the common grounding members 502 always contact each other, is employed. It is assumed that the user contacts the exposure head 106 during the drawing-out of the inner casing 400 from the apparatus main assembly 500. In such a case, the common grounding members 502 are provided closer to the user's side than to the driving substrate 202 side, and therefore, the static electricity moved from the user's fingers flows into the apparatus main assembly grounding members 501 of the apparatus main assembly 500 along the common grounding members 502. For that reason, it becomes possible to suppress movement of the static electricity to electric elements of the exposure head 106.

Further, as shown in part (b) of FIG. 6, when the inner casing 400 is in the drawn-out position where the inner casing 400 is drawn out of the apparatus main assembly 500, a force by which the inner casing 400 moves downward in a vertical direction by its self-weight acts on the inner casing 400. At this time, the rear side of the inner casing 400 is raised in the vertical direction, and therefore, the rear side of the common grounding members 502 are pressed against the apparatus main assembly grounding members 501. That is, the apparatus main assembly grounding members 501 are provided in front of the frame 507 which is the accommodating portion, so that the common grounding members 502 and the apparatus main assembly grounding members 501 can be contacted to each other further reliably. The common grounding member 502 and the apparatus main assembly grounding members 501 are in contact with each other on the upstream side with respect to the drawing-out direction of the inner casing 400.

Further, as shown in part (b) of FIG. 6, end portions of the common grounding members 502 on the front side (downstream side with respect to the drawing-out direction of the inner casing 400) (one end side) extend further to the downstream side of the drawing-out direction of the inner casing 400 than the exposure head 106, disposed on the frontmost side of the inner casing 400, of the exposure heads 106 extends. As a result, even in the case where the inner casing 400 is in the accommodated position, the apparatus main assembly grounding members 501 provided in front of the frame 507 and the common grounding members 502 can be further reliably contacted to each other.

In other words, when the inner casing 400 is in the accommodated position, with respect to the direction in which the inner casing 400 moves from the accommodated position toward the drawn-out position, the apparatus main assembly grounding members 501 (second grounding member) are positioned downstream of the optical print head (exposure head) 106K. Further, when the inner casing 400 is in the drawn-out position, with respect to the direction in which the inner casing 400 moves from accommodated position toward the drawn-out position, the apparatus main assembly grounding members 501 (second grounding member) is positioned upstream of the optical print head (exposure head) 106Y.

Another Embodiment

With reference to FIG. 7, another embodiment (constitution) in which the exposure heads 106 and the grounding members of the apparatus main assembly 500 are grounded will be described. Part (a) of FIG. 7 is a top view of the apparatus main assembly 500 as seen from above, in which "FR" represents the front (surface) side of the apparatus main assembly 500, and "RR" represents the rear (surface) side of the apparatus main assembly 500. Part (b) of FIG. 7 is a side view of the apparatus main assembly 500 as seen from the side surface of the apparatus main assembly 500. Incidentally, constituent elements which are the same as those described with reference to FIG. 6 will be omitted from description by adding the same reference numerals or symbols.

Rail-shaped members 510 which are the grounding members for the apparatus main assembly 500 side are provided on the apparatus main assembly 500 side. For example, as shown in part (b) of FIG. 7, in the apparatus main assembly 500, the rail-shaped members 510 are constituted by rail-shaped members made of metal provided on an upper side of the frame 507 constituting the accommodating portion for accommodating the inner casing 400.

On the other hand, at both end portions of the inner casing 400 with respect to the left-right direction on an upper surface side of the inner casing 400, metal members 520, which always contact the rail-shaped members 510 from a state in which the inner casing 400 is accommodated in the apparatus main assembly 500 to a state in which the inner casing 400 is drawn out of the apparatus main assembly 500, are provided. Each of the exposure heads 106 is provided with connecting wires 530 connected to the metal members 520. As a result, the exposure head 106 is connected to the rail-shaped members 510 through the connecting wires 530 and the metal members 520. For this reason, even when the inner casing 400 is drawn out of the apparatus main assembly 500, the rail-shaped members 510 and the metal members 520 are always in contact with each other. For this reason, it becomes possible to suppress the movement of the static electricity to the electric elements of the exposure head 106. That is, when the inner casing 400 moves between the accommodated position to the drawn-out position, the rail-shaped members 510 and the metal members 520 contact each other. In order to establish grounding of the exposure head 106 with reliability, it is desirable that the rail-shaped members 510 and the metal members 520 are always in contact with each other, but a constitution in which the rail-shaped members 510 and the metal members 520 are partially in non-contact with each other may also be employed. Specifically, for example, a part of the rail-shaped members 510 is cut away, and at cut-away portions, the metal members 520 may also be separated from the rail-shaped members 510. Further, the rail-shaped members 510 may also be discretely provided.

Incidentally, in part (b) of FIG. 7, the connecting wires 530 are illustrated by broken lines which are downwardly convex curves from an easy-to-see viewpoint. However, the connecting wires 530 are, for example, provided along the upper surface of the inner casing 400 so as not to prevent accommodation of the exposure heads 106 and the image forming portion. Further, another form may also be employed, in which the exposure heads 106 and the metal members can be connected to each other.

In FIG. 6, on the upper surface side of the inner casing 400, the apparatus main assembly grounding members 501 and the common grounding members 502 are connected with each other. In FIG. 7, on the upper surface side of the inner casing 400, the rail-shaped members 510 and the metal members 520 connected to the connecting wires 530 of the exposure heads 106 are connected with each other. Thus, by connecting the members for establishing casing state grounding with the apparatus main assembly side on the upper surface side of the inner casing 400, the following effect is achieved. When the inner casing 400 is drawn out to the front side, the drawing-out front side is inclined downward by the influence of gravitation, and by reaction thereof, the rear side of the inner casing 400 is inclined upward in some instances. Even in such a case, it is possible to maintain a state in which the grounding members on the apparatus main assembly side and the inner casing side are always in contact with each other.

Incidentally, for example, common grounding members are provided on side-surface sides of the exposure heads 106 and apparatus main assembly grounding members are provided on side surfaces of the frame 507, of the apparatus main assembly 500, opposing the inner casing 400, and the common grounding members and the apparatus main assembly grounding members may also be connected with each other on the side surfaces of the apparatus main assembly. Similarly, metal members connected to the connecting wires of the exposure heads 106 are provided on the side walls 504 and rail-shaped members are provided on the apparatus main assembly-side frame opposing the side walls 504, and these members may also be connected with each other.

Further, in the case where the inner casing 400 has a bottom made of metal, a constitution in which inner casing-side grounding members are provided on a bottom side of the inner casing 400 and apparatus main assembly-side grounding members are provided on the apparatus main assembly-side frame 507 opposing the bottom side of the inner casing 400 may also be employed. In this case, the exposure heads 106 may only be required to be connected to the grounding members provided on the bottom of the inner casing 400 through a metal portion of the inner casing 400. Further, inside the door 410 of the apparatus main assembly 500, grounding members on the apparatus main assembly side may also be additionally provided.

As described above, it is desirable that the common grounding members as the first grounding member and the apparatus main assembly grounding members as the second grounding member are always in the contact state when the inner casing 400 moves between the accommodated position and the drawn-out position. However, it is not necessarily required that the first grounding member and the second grounding member always contact each other; the first grounding member and the second grounding member may also be temporarily separated from each other during the drawing-out of the inner casing 400. Due to a tolerance between component parts, some gap is formed between the accommodating portion and the inner casing 400 in some instances. Further, in the case where it is considered that the mounting and drawing-out operation of the inner casing 400 is made easy, the inner casing 400 may desirably be assembled with the accommodating portion with play. In view of this point, when an operator such as the user or a service person performs the drawing-out and mounting operation of the inner casing 400, a contact state between the first grounding member and the second grounding member is unintendedly eliminated in some instances. Here, "the first grounding member and the second grounding member always in the contact state" refers to a state also including the above-described status.

As described above, according to the embodiment 1, in the constitution in which the casing including the photosensitive drums and the exposure heads is capable of being drawn out of the image forming apparatus main assembly, even when the casing is moved relative to the image forming apparatus main assembly, it is possible to establish grounding of the exposure heads with the grounding member.

Embodiment 2

In the embodiment 1, the constitution in which the common grounding members 502 (the example of the inner casing-side grounding member) connecting the four electroconductive portions 107, and the apparatus main assembly grounding members 501 are connected with each other, and the like constitution were described. In an embodiment 2, as shown in FIG. 8, a constitution in which the electroconductive portions 107 are connected to common grounding members 503 connected to the photosensitive drums 102, the charging devices 402 and the developing devices 403 which constitute the inner casing 400 will be described. The common grounding members 503 of the inner casing 400 are connected to the apparatus main assembly grounding members 501.

As shown in FIG. 8, the electroconductive portions 107 do not directly contact the apparatus main assembly grounding members 501. However, the electroconductive portions 107 are connected to the common grounding members 503 of the inner casing 400. For this reason, the electroconductive portions 107 are connected to the apparatus main assembly grounding members 501 through the common grounding members 503.

The common grounding members 503 have a constitution in which the common grounding members 503 are always in contact with the apparatus main assembly grounding members 501 even during the drawing-out of the inner casing 400 from the apparatus main assembly 500.

Further, the common grounding members 503 may also constitute a part of the side walls 504 of the inner casing 400. By employing such a constitution, the electroconductive portions 107 are connected to the apparatus main assembly grounding members 501 through the common grounding members 503, and even when the user touches the exposure heads 106, the static electricity can escape to the apparatus main assembly grounding members 501. For this reason, it becomes possible to suppress the static electricity from moving to the electric elements of the exposure heads 106.

As described above, according to the embodiment 2, in the constitution in which the casing including the photosensitive drums and the exposure heads is capable of being drawn out of the image forming apparatus main assembly, even when the casing is moved relative to the image forming apparatus main assembly, it is possible to establish grounding of the exposure heads with the exposure heads.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-202689 filed on Oct. 29, 2018, which is hereby incorporated by reference herein in its entirety.

What is claimed is:

1. An image forming apparatus comprising:

a drawer unit accommodated in an accommodating portion provided in the image forming apparatus and capable of being drawn out of the accommodating portion, the drawer unit including a detachable unit, detachable from the drawer unit, having a photosensitive member, and an LED exposure head including a housing having a substrate provided with a plurality of light emitting elements configured to emit light to expose the photosensitive member and an electroconductive member of metal provided with the housing away from the substrate; and a grounding member provided with the accommodating portion and being grounded, wherein the electroconductive member and the grounding member are in a conductive state in a case in which the drawer unit is drawn out to a position where the detachable unit is capable of being drawn out of the drawer unit.

2. The image forming apparatus according to claim 1, wherein the drawer unit is capable of being drawn out to a front side of the image forming apparatus.

3. The image forming apparatus according to claim 1, wherein the LED exposure head exposes the photosensitive member from above, and the detachable unit is detachable from an upper side of the drawer unit from above in a case in which the drawer unit is drawn out of the image forming apparatus.

4. An image forming apparatus according to claim 3, wherein the electroconductive member is a first electroconductive member, and the image forming apparatus further comprises a second electroconductive member of metal provided with the drawer unit and extending in a direction in which the drawer is drawn out, the second electroconductive member and the first electroconductive member being in a conductive state, and wherein the grounding member is provided above the second electroconductive member.

5. The image forming apparatus according to claim 4, wherein the grounding member is a leaf spring, and the grounding member presses the second electroconductive member downwardly.

6. The image forming apparatus according to claim 4, wherein the grounding member and the second electroconductive member are always in a conductive state while the drawer unit is drawn out of the image forming apparatus.

7. The image forming apparatus according to claim 1, wherein the plurality of light emitting elements are light emitting diodes.

8. The image forming apparatus according to claim 1, wherein the plurality of light emitting elements are organic light emitting diodes.

9. The image forming apparatus according to claim 1, wherein the drawer unit includes:

a first detachable unit, which is the detachable unit, having a first photosensitive member, which is the photosensitive member, a second detachable unit, detachable from the drawer unit, having a second photosensitive member, a third detachable unit, detachable from the drawer unit, having a third photosensitive member, a fourth detachable unit, detachable from the drawer unit, having a fourth photosensitive member, a first LED exposure head which is the LED exposure head, a second LED exposure head exposing the second photosensitive member, a third LED exposure head exposing the third photosensitive member, and a fourth LED exposure head exposing the fourth photosensitive member, and wherein the first detachable unit, the second detachable unit, the third detachable unit and the fourth detachable unit are arranged in the listed order from a front side to a rear side of the drawer unit.

10. The image forming apparatus according to claim 9, wherein the drawer unit is capable of being drawn out to a front side of the image forming apparatus.

11. The image forming apparatus according to claim 9, wherein the first LED exposure head exposes the first photosensitive member from above, the second LED exposure head exposes the second photosensitive member from above, the third LED exposure head exposes the third photosensitive member from above, the fourth LED exposure head exposes the fourth photosensitive member from above, and the first, second, third and fourth detachable units are detachable from an upper side of the drawer unit from above in a case in which the drawer unit is drawn out of the image forming apparatus.

12. The image forming apparatus according to claim 9, wherein the electroconductive member is a first electroconductive member, the image forming apparatus further comprises a second electroconductive member of metal provided with the drawer unit and extending in a direction in which the drawer is drawn out, the second electroconductive member and the grounding member being in a conductive state, and the grounding member is provided above the second electroconductive member.

13. The image forming apparatus according to claim 12, wherein the second electroconductive member and the grounding member are in a conductive state in a case in which the drawer unit is drawn out to a position where the fourth detachable unit is capable of being drawn out of the drawer unit.

14. The image forming apparatus according to claim 12, wherein the grounding member and the second electroconductive member are in a conductive state while the drawer unit is drawn out in a range from a position where the first detachable unit is capable of being drawn out of the drawer unit to a position where the fourth detachable unit is capable of being drawn out of the drawer unit.

15. The image forming apparatus according to claim 9, wherein the plurality of light emitting elements are light emitting diodes.

16. The image forming apparatus according to claim 9, wherein the plurality of light emitting elements are organic light emitting diodes.

* * * * *